US009033603B2

(12) United States Patent
Vanoncini et al.

(10) Patent No.: US 9,033,603 B2
(45) Date of Patent: May 19, 2015

(54) CONTAINER WITH IMPROVED OPENING SYSTEM

(75) Inventors: Stefano Vanoncini, Osnago (IT); Anna Poletto, Monza MB (IT); Ambrogio Fumagalli, Castello Brianza LC (IT); Bruno Boccardo, Genoa (IT)

(73) Assignee: BRIVAPLAST S.r.L., Milan (IT)

( * ) Notice: Subject to any disclaimer, the term of this patent is extended or adjusted under 35 U.S.C. 154(b) by 734 days.

(21) Appl. No.: 13/345,136

(22) Filed: Jan. 6, 2012

(65) Prior Publication Data

US 2012/0177432 A1 Jul. 12, 2012

(30) Foreign Application Priority Data

Jan. 11, 2011 (IT) ..... MI2011A0014

(51) Int. Cl.

| | |
|---|---|
| ***A46B 11/00*** | (2006.01) |
| ***B65D 51/32*** | (2006.01) |
| ***A45D 34/04*** | (2006.01) |
| ***A45D 40/26*** | (2006.01) |
| *B65D 41/04* | (2006.01) |

(52) U.S. Cl.

CPC ..... *B65D 51/32* (2013.01); *B65D 41/0428* (2013.01); *A45D 34/045* (2013.01); *A45D 40/265* (2013.01); *A45D 2200/051* (2013.01)

(58) Field of Classification Search

USPC ..... 401/121, 122, 126–130; 215/329, 331, 215/332, 335, 339, 356; 200/323, 524

See application file for complete search history.

(56) References Cited

U.S. PATENT DOCUMENTS

| | | | | |
|---|---|---|---|---|
| 4,383,619 | A * | 5/1983 | Mumford et al. | 215/222 |
| 4,526,281 | A * | 7/1985 | Herr | 215/211 |
| 5,148,931 | A * | 9/1992 | Minh | 215/220 |

FOREIGN PATENT DOCUMENTS

| | | |
|---|---|---|
| DE | 195 08 836 | 9/1996 |
| DE | 195 25 173 A1 | 1/1997 |
| DE | 102 29 693 A1 | 1/2004 |
| EP | 1 800 561 A1 | 6/2007 |

OTHER PUBLICATIONS

Search Report for IT MI20110014; May 18, 2011.

* cited by examiner

*Primary Examiner* — David Walczak

(74) *Attorney, Agent, or Firm* — Pearne & Gordon LLP

(57) ABSTRACT

Container for liquid or paste-like products, of the type consisting of a tank and of a closing cap of said tank and a handle for a stem carried by said cap, said tank consisting of a cylindrical body, limited above by a neck, said stem being configured to be introduced through said neck and having at the distal end thereof an application unit, characterized in that on the outer periphery of said neck there are provided relief shaped elements guiding and retaining pin elements projecting internally from said cap, said shaped elements consisting of a serrated, annular base crown and a series of guiding and retaining bodies, the axis of which is angled with respect to the axis of said tank 1 , said bodies being mutually separated and separated from said annular crown by a channel.

14 Claims, 5 Drawing Sheets

Fig.7b
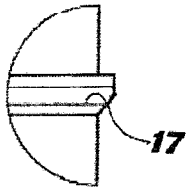
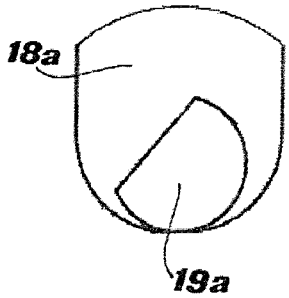
Fig.7c
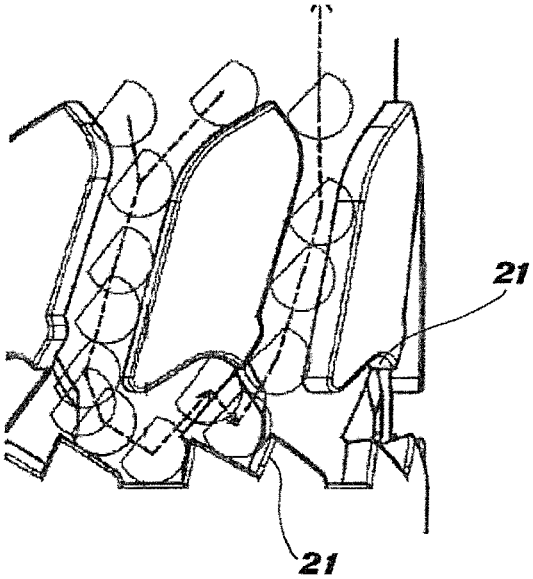
Fig.8

CONTAINER WITH IMPROVED OPENING SYSTEM

The present invention concerns a container for liquid or paste products, in particular for cosmetics, provided with an opening system apt to allow fast opening and at the same time guarantee sealing when it is not used.

It has been known for some time in the field of cosmetics the use of tools for the collection and the subsequent distribution of paste, liquid or gel-like products, apt to be distributed on the surfaces of interest. Typically, such tools consist of a container made up of a tank, apt to contain the substance to be applied, of a stem carrying at the distal end thereof an applicator, and of a closing element which normally consists of a cap kept engaged with the top of the stem-shaped element.

As is fully evident, it is necessary for the container to keep a perfect sealing to the air and to any spilling, when it is not used, so as to maintain the physical-chemical properties of the agent contained therein, and to reduce to a minimum the risk of contact with the air. For such purpose, the solution consisting of the coupling thread/screw-counterthread between the tank and the cap has been universally adopted.

However, it has been detected that the screw cap proves rather problematic to manage upon opening, because the undesired deposition on the edge of the tank neck tends to act as glue, consequently hindering cap unscrewing operations.

Moreover, for some user categories, it is particularly difficult to have to impart the necessary torsion force to the cap to open or close the container, for example because they suffer from syndromes to the upper limbs, or because they are elderly.

Finally, it has been detected that the conventional system necessarily requires the engagement of both hands and particular care, to be able to proceed to the opening and closing of the container: this may prove particularly unfavourable when the user does not have both hands free and must apply the product quickly.

The object of the present invention is therefore to propose a container which may overcome the above-said disadvantages, and which is in particular capable of offering a fast opening, possibly also with a single hand, which does not require screw engagement, nor the application of a torsion force, but which guarantees at the same time the required sealing.

Said object is achieved through a container having the features reported in claim 1, the dependant claims reporting some preferred features of the invention.

The invention will now be described with reference to the attached drawings, which show a particularly preferred embodiment, wherein:

FIG. 3 is the perspective view of the tank body of the container according to the invention, of which

Figure 1:
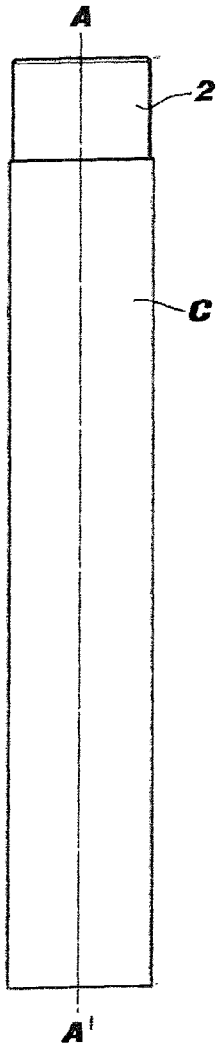
FIG. 1 is a front view of a container according to the invention, ready for marketing.
Figure 2:
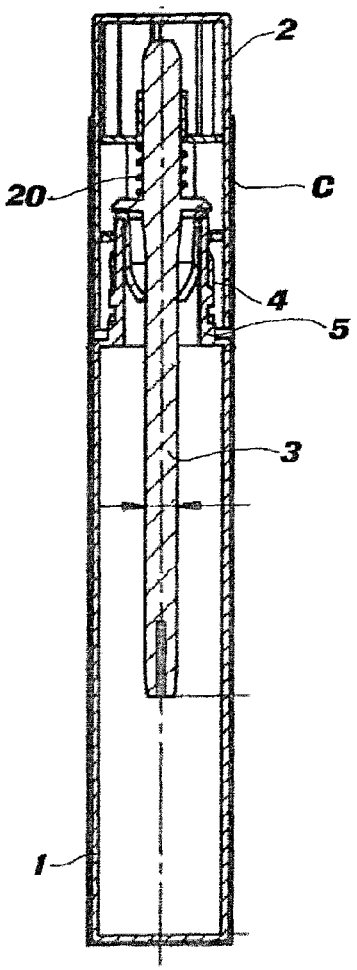
FIG. 2 is the section view along line A-A' of the container of FIG. 1.
Figure 3:
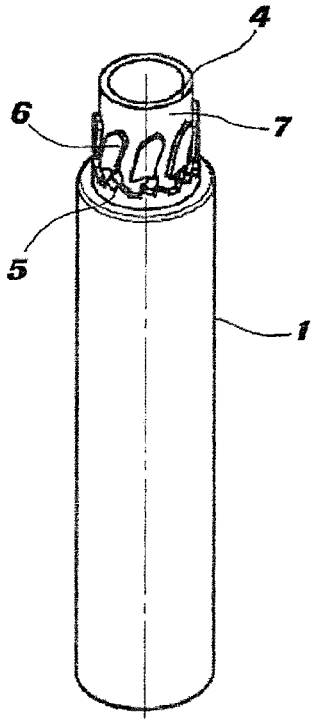
Figure 4:
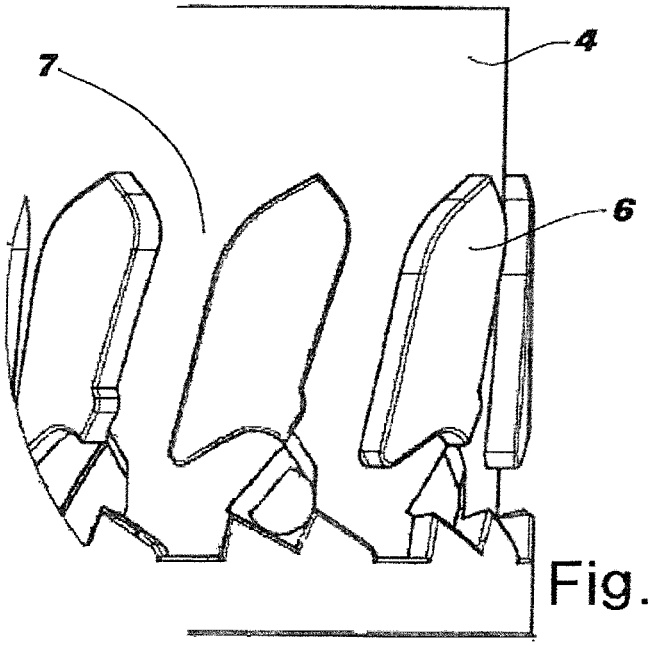
FIG. 4 is the enlarged view of a detail.
Figure 5:
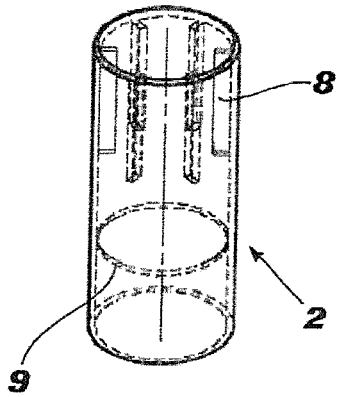
FIG. 5 is a top, clear, perspective view of the cap element of the container according to the invention.
Figure 5A:
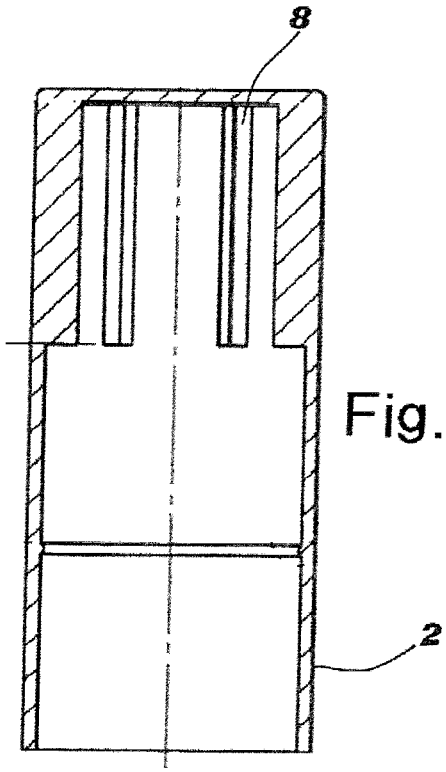
Figure 5B:
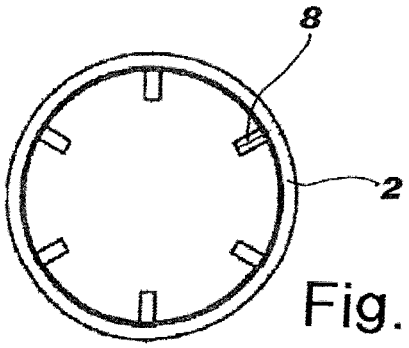
Figure 7:
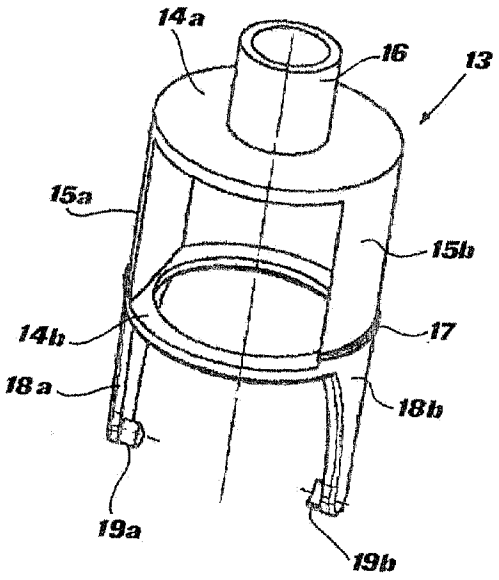
Figure 7A:
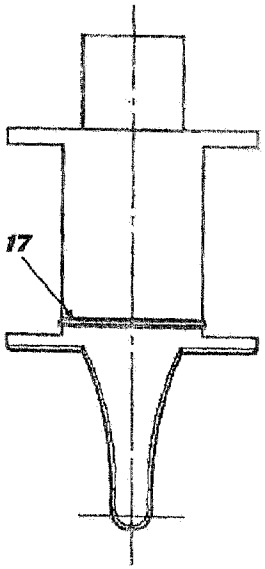
Figure 6:
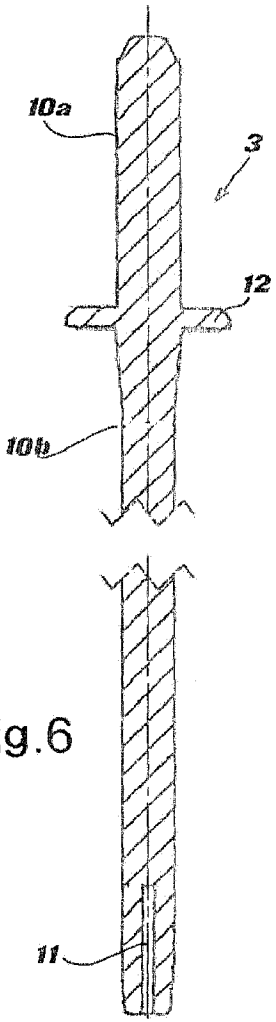

FIGS. 5*a* and 5*b* are the views in a longitudinal section and from above, respectively, of the cap of FIG. 5;

FIG. 6 is the section view of the rod element of the container according to the invention;

FIG. 7 is a perspective view of the rotary unit element of the container according to the invention, of which FIG. 7*a* is a lateral-front view, and FIG. 7*b* and 7*c* are views of details of engagement elements;

FIG. 8 is the view of FIG. 4, wherein the engagement is illustrated in a schematic and kinematic way which forms with the engagement elements of FIG. 7*c*.

The container according to the invention is of the conventional type, generically consisting of a tank 1 and of a closing cap 2, with which a stem 3 supporting an applicator, tank 1 and the handle for such stem 3 is associated through suited retaining means.

Tank 1 consists of a cylindrical body, at the end of which a neck 4 is provided, apt to the introduction of stem 3, and to the tightening of cap 2 to tank 1. As a cover of tank 1 there is further provided a sleeve C having such a size as to allow tank 1 to fit tightly within. Sleeve C extends in height up to about halfway the neck 4, so as to allow—with the closed container—a partial overlapping of sleeve C on cap 2.

Neck 4 has on the outer surface thereof a serrated, annular base crown 5, surmounted by a series of mutually equidistant relief bodies 6, having an approximately ogival shape, on the basis of which a niche is obtained, separated from said annular crown 5 by a channel 7. Said channel 7 extends also vertically between said relief bodies 6, so much so that a continuous path is easily recognisable along the neck perimeter, wherefrom some accidental points depart to the upper part of said neck 4. As can be detected from the drawings, the axis of such bodies 6 is angled to the axis of tank 1. Preferably, the angle of said bodies 6 is not above 20°, more preferably it is equal to 14°.

The cap element 2 consists of a cylindrical cap, which carries at the top thereof, along the inner surfaces, mutually equidistant, radial partitions 8 converging towards the centre, which extend downwards along the inner lateral wall of cap 2, and a semi-toroidal retaining element 9 located about two thirds of the length of said cap element 2.

Stem 3, illustrate in section in FIG. 6, is of the type generically consisting of a cylindrical head element 10*a* and of a body having a conical base 10*b* which tapers vertically downwards, and which provides at the thinner end a seat 11 for the introduction of the applicator (not shown). To separate head 10*a* from body 10*b* there is provided a horizontal, flanged element 12 having a diameter substantially identical to the one of neck 4, so as to identify the necessary presence of a lid at the top of neck 4.

Finally, to guarantee the movement and the engagement of cap 2 with respect to container 1, between cap 2 and stem 3 there is arranged a rotary unit 13, as illustrated in FIG. 7, consisting of a pair of parallel disc-shaped elements 14*a*, 14*b* with a central hole, kept mutually joined by two side walls 15*a*, 15*b*. The diameter of said disc-shaped elements 14*a*, 14*b* is substantially different to allow the engagement with stem 3 and with neck 4, respectively: thereby, rotary unit 13 lies perfectly axially aligned with the tank 1 of the container and guarantees perfect stability to the structure thus accomplished when it is not used.

For stem 3 to be perfectly centred, in correspondence of the central hole of the upper disc-shaped element 14*a* there is provided a retaining collar 16: this, also by virtue of the particular conical shape of stem 3, has the double function of keeping axially aligned stem 3, and to maintain rotary unit 13 in engagement with head 10*a*, so as to offer an optimal travel of rotary unit 13 with respect to stem 3.

Guiding cap 2 to the precise introduction on neck 4, so as to further guarantee the centering of stem 3, it has been provided for the sleeve portion C externally surrounding neck 4 to act as centering element of cap 2, allowing it no transversal play.

As highlighted in FIGS. 7*a* and 7*b*, for rotary unit 13 to be kept in engagement with cap 2, on the outer surface of side walls 15*a*, 15*b* there is provided a semi-toroidal element 17 of engagement with the semi-toroidal element 9 of cap 2.

Moreover, from lower disc-shaped element 14*b* two appendixes 18*a*, 18*b* depart having a triangular profile, at the ends of which suitably-shaped, pin-like engagement elements 19*a*, 19*b* project internally.

As a matter of fact, as clearly illustrated in FIG. 7*c*, said elements 19*a*, 19*b* consist of pegs with a substantially circular base, from which a portion of arch has been removed subtended to a rope of a length below a diameter, and they have a size such as to be able to be slideably introduced into channel 7.

Preferably, along the head 10*a* of stem 3 there is inserted a spring 20 lying between flanged element 12 and the lower surface of upper disc-shaped element 14*a*, so as to guarantee the fast and automatic releasing movement of cap 2 during the operation of the container, as will be better understood from the following explanation.

From the preceding description the carrying out of the container according to the invention and the operation thereof can be easily understood.

During mounting, firstly spring 20 is introduced, so that it may rest below on the upper surface of flanged element 12. Subsequently the head 10*a* of stem 3 is introduced through the central holes of the disc-shaped elements, in succession 14*b* and then 14*a*, causing element 12 to snap beyond element 14*b*, overcoming the resistance of spring 20, so that the lower surface of element 12 rests on the upper surface of element 14*b*. Finally, the thus resulting stem—rotary-unit assembly is introduced into cap 2 so that semi-toroidal element 17 snaps above toroidal element 9.

Once such assembly has been accomplished, stem 3—now integral with cap 2 and rotary unit 13—is introduced into tank 1, and consequently pins 19*a*, 19*b* are brought into two opposite channels 7, according to the pathway illustrated for one of the two pins in FIG. 8. Through the sole downward push of cap 2 the pins are brought along channel 7 until they come in contact with the serrated surface 5 of neck 4, and find a halt position (indicated by 21 in FIG. 8) in correspondence of the shape of reliefs 6.

In this condition, the tightening is obtained through the tension provided by spring 20 which at the same time pushes stem 3 downwards and the combination of cap 2 with rotary unit 13 upwards, in antagonism with neck 4.

When the user wants to apply the product, he must only push on cap 2, so that pins 19*a*, 19*b* are displaced from the balance position and are induced, due to the geometries of reliefs 5 and 6 to rise back along channel 7.

In this step the system consisting of the cap, the rotary unit and the stem frees itself from the contrast given by the elements on neck 4. The tension of spring 20 loosens until element 12 finds a new contrast on the upper surface of element 14*b*. In the meantime, pins 19*a*, 19*b* have got to the top of neck 4, and the user may consequently remove the application and closing system and use some of the agent contained in the tank in the most suitable way.

From the preceding description it is evident that the set object has thus been obtained, i.e. of a fast-opening container, without the presence of a screw engagement, and which guarantees at the same time the required sealing. As a matter of fact, the synergy between the particular shape of the elements provided on neck 4 and of the engagement elements associated with cap 2 guarantees the closing and the opening of the container in a fast and effective manner, according to the user's wishes.

It is furthermore evident that to the solution described above non-substantial changes may be made, accomplishing alternative embodiments, without departing from the scope of protection of the patent, which is defined by the attached claims.

The invention claimed is:

1. A container for liquid or paste products, consisting of:

a tank, a closing cap of said tank, and a stem carried by said closing cap, said tank consisting of a cylindrical body, limited above by a neck, said stem being arranged for introduction through said neck and having at a distal end thereof an application unit, wherein on an outer periphery of said neck there are provided shaped relief elements for guiding and retaining of peg-like elements projecting internally from said cap, said shaped relief elements consisting of a bottom, annular, serrated crown and of a series of guiding and retaining bodies, an axis of said bodies being at an angle to an axis of said tank, and said bodies being separated from one another and from said annular crown by a channel.

2. The container of claim 1, wherein said guiding and retaining bodies have a substantially ogival shape comprising a recess.

3. The container of claim 1, wherein the angle of the axis of the guiding and retaining bodies with respect to the axis of the tank ranges between 0 and 20°.

4. The container of claim 3, wherein said angle is 14°.

5. The container of claim 1, wherein said peg-like elements project from appendixes protruding from a rotary unit kept engaged within said cap.

6. The container of claim 5, wherein said rotary unit consists of a pair of disc-shaped parallel elements with a central hole, kept mutually joined by two side walls.

7. The container of claim 5, wherein the engagement between said cap and said rotary unit is accomplished, below, by a snap-engagement between two protruding elements having a semi-toroidal profile arranged on an outer bottom surface of said rotary unit and on an inner surface of said cap, respectively, and, above, by an engagement between an upper surface of an upper, disc-shaped element and radial partitions provided along an inner side wall of the cap.

8. The container of claim 7, wherein said upper, disc-shaped element has a diameter apt to allow the introduction of the stem, and a lower, disc-shaped element has a diameter apt to allow the engagement with said neck.

9. The container of claim 8, wherein from said upper, disc-shaped element a retaining collar departs.

10. The container of claim 9, wherein said stem consists of a substantially cylindrical head and a conical-base body, which tapers in a vertical direction, at a thinner end a seat being provided for introduction of the application unit, said head and said conical body being separated by a circular, flanged body having a diameter substantially identical to the one of said container neck.

11. The container of claim 10, wherein a maximum diameter of said conical-base body is larger than the diameter of said retaining collar.

12. The container of claim 1, wherein said peg-like elements have a substantially circular shape, wherefrom an arc portion has been subtended to a rope of a length shorter than a diameter.

13. The container of claim 1, wherein along the stem a spring is laid between a flanged element and a lower surface of an upper, disc-shaped element, said spring being apt to displacement of said cap.

14. The container of claim 1, wherein a sleeve covering said tank is further provided, said sleeve extending vertically to partly cover said neck.

* * * * *